US007918688B2

(12) United States Patent
Lin et al.

(10) Patent No.: US 7,918,688 B2
(45) Date of Patent: Apr. 5, 2011

(54) ELECTRICAL CONNECTOR WITH TERMINAL SOLDERING PATTERN

(75) Inventors: Sheng-Chan Lin, Hsin-Tien (TW); Pin-Yuan Hou, Hsin-Tien (TW); Wen-Hsien Tsai, Hsin-Tien (TW); Ching-Tien Chen, Shin-Tien (TW)

(73) Assignee: Advanced Connectek Inc., Taipei Hsien (TW)

( * ) Notice: Subject to any disclaimer, the term of this patent is extended or adjusted under 35 U.S.C. 154(b) by 67 days.

(21) Appl. No.: 12/384,366

(22) Filed: Apr. 3, 2009

(65) Prior Publication Data

US 2010/0167583 A1 Jul. 1, 2010

(30) Foreign Application Priority Data

Dec. 30, 2008 (TW) ..... 97223623 U

(51) Int. Cl.
*H01R 13/648* (2006.01)

(52) U.S. Cl. ..... 439/607.01

(58) Field of Classification Search ..... 439/607.01–607.08, 101, 108
See application file for complete search history.

(56) References Cited

U.S. PATENT DOCUMENTS

| | | | | |
|---|---|---|---|---|
| 6,050,850 | A * | 4/2000 | Crane et al. | 439/569 |
| 6,146,157 | A * | 11/2000 | Lenoir et al. | 439/101 |
| 6,371,813 | B2 * | 4/2002 | Ramey et al. | 439/607.05 |
| 6,561,850 | B2 * | 5/2003 | Letourneau et al. | 439/607.08 |
| 7,410,392 | B2 * | 8/2008 | Szczesny et al. | 439/607.05 |
| 7,513,797 | B2 * | 4/2009 | Scherer et al. | 439/607.01 |
| 7,670,156 | B2 * | 3/2010 | Chen | 439/108 |
| 7,722,399 | B2 * | 5/2010 | Scherer et al. | 439/607.05 |

* cited by examiner

*Primary Examiner* — Chandrika Prasad
(74) *Attorney, Agent, or Firm* — William E. Pelton, Esq.; Cooper & Dunham LLP

(57) ABSTRACT

An electrical connector has an insulative housing, a plurality of terminals and a metal shell. The terminals are mounted through the insulative housing and each terminal has a mounting section, a contacting section and a soldering section. The soldering sections of all the terminals are arranged in triangular patterns. Each soldering section is located in a tip of one triangular pattern. Distances between one soldering section and adjacent soldering sections are substantially identical. The triangular patterns of the soldering section stabilize the impedance of the operating electrical connector. Therefore, the electrical connector is stable and reliable.

7 Claims, 8 Drawing Sheets

ELECTRICAL CONNECTOR WITH TERMINAL SOLDERING PATTERN

BACKGROUND OF THE INVENTION

1. Field of the Invention

The present invention relates to a connector, and more particularly to an electrical connector that has a specific terminal layout to improve the stability of high frequency signal transmission.

2. Description of Related Art

Because people are more and more fussy about the movie and pictures qualities rendered on monitors, digital video protocols for video products have been developed and updated to have high transmission frequency for the high data flow rate.

Conventional video connectors are generally mounted on printed circuit boards (PCBs) by the surface mount technology (SMT) process. Few video connectors are mounted by the through hole process. However, mounting the video connector on the PCBs by any one process would cause the impedance of the terminals of the video connector unstable when the video connector is operating.

To overcome the shortcomings, the present invention provides an electrical connector to mitigate or obviate the aforementioned problems.

SUMMARY OF THE INVENTION

The main objective of the invention is to provide an electrical connector that has a specific terminal layout to improve the stability of high frequency signal transmission.

An electrical connector has an insulative housing, a plurality of terminals and a metal shell. The terminals are mounted through the insulative housing and each terminal has a mounting section, a contacting section and a soldering section. The soldering sections of all the terminals are arranged in triangular patterns. Each soldering section is located in a tip of one triangular pattern. Distances between one soldering section and adjacent soldering sections are substantially identical.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
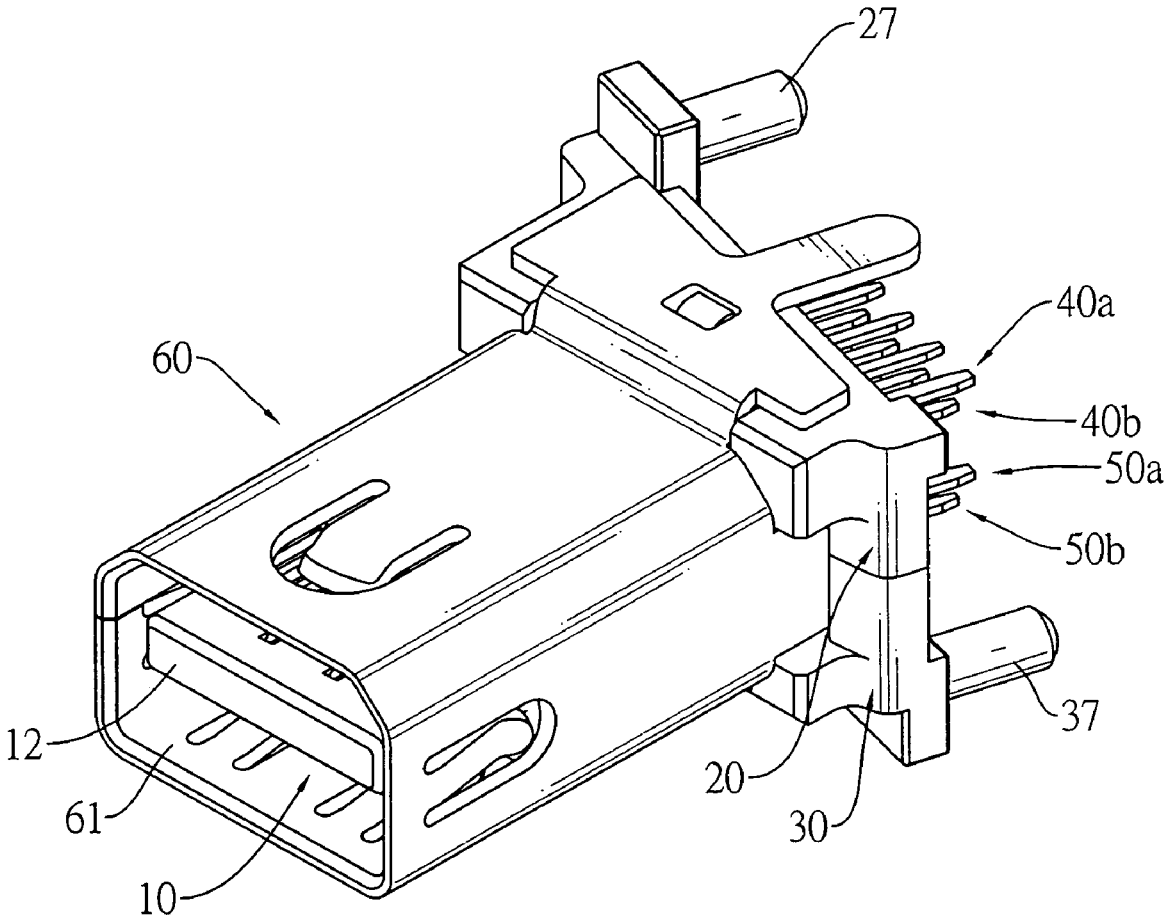
FIG. 1 is a front perspective view of an electrical connector in accordance with the present invention.
Figure 2:
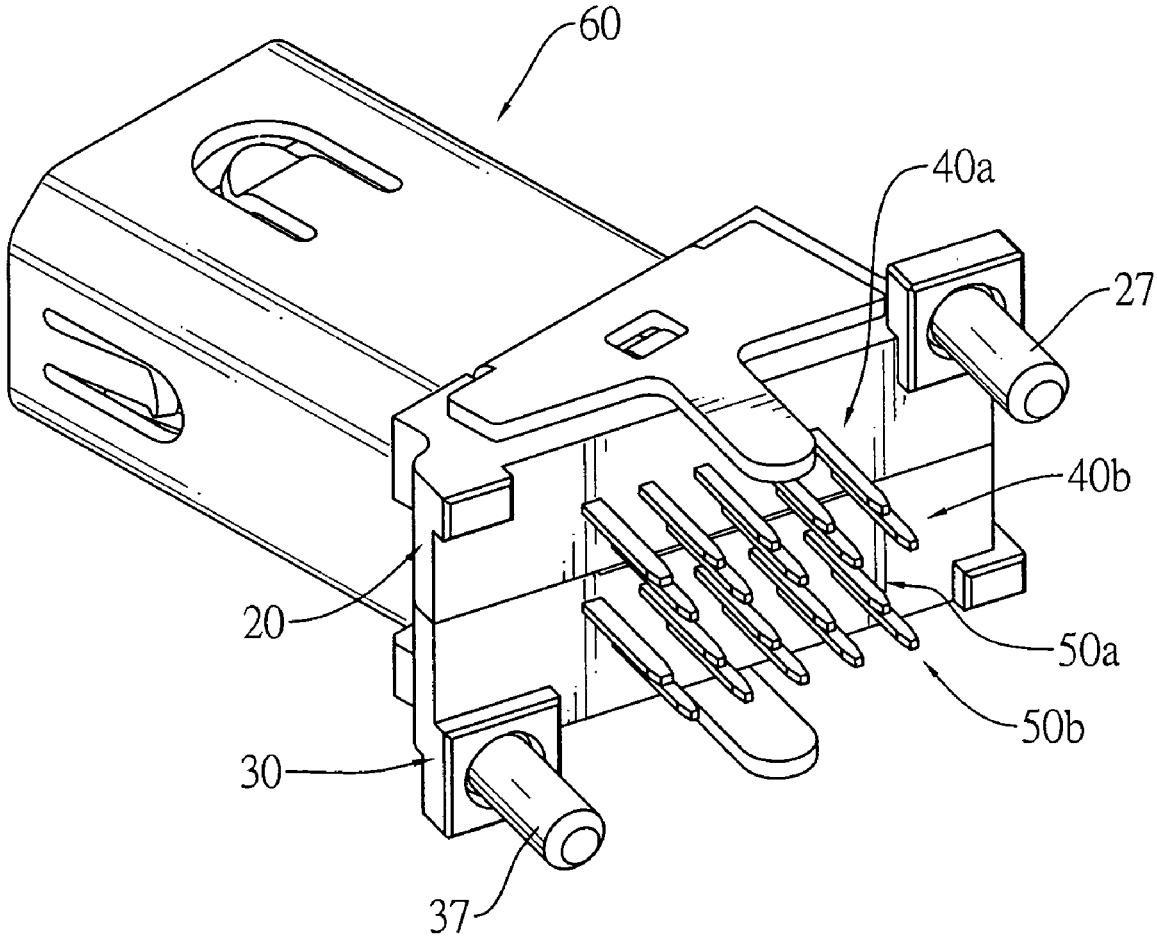
FIG. 2 is a rear perspective view of the electrical connector in FIG. 1.
Figure 3:
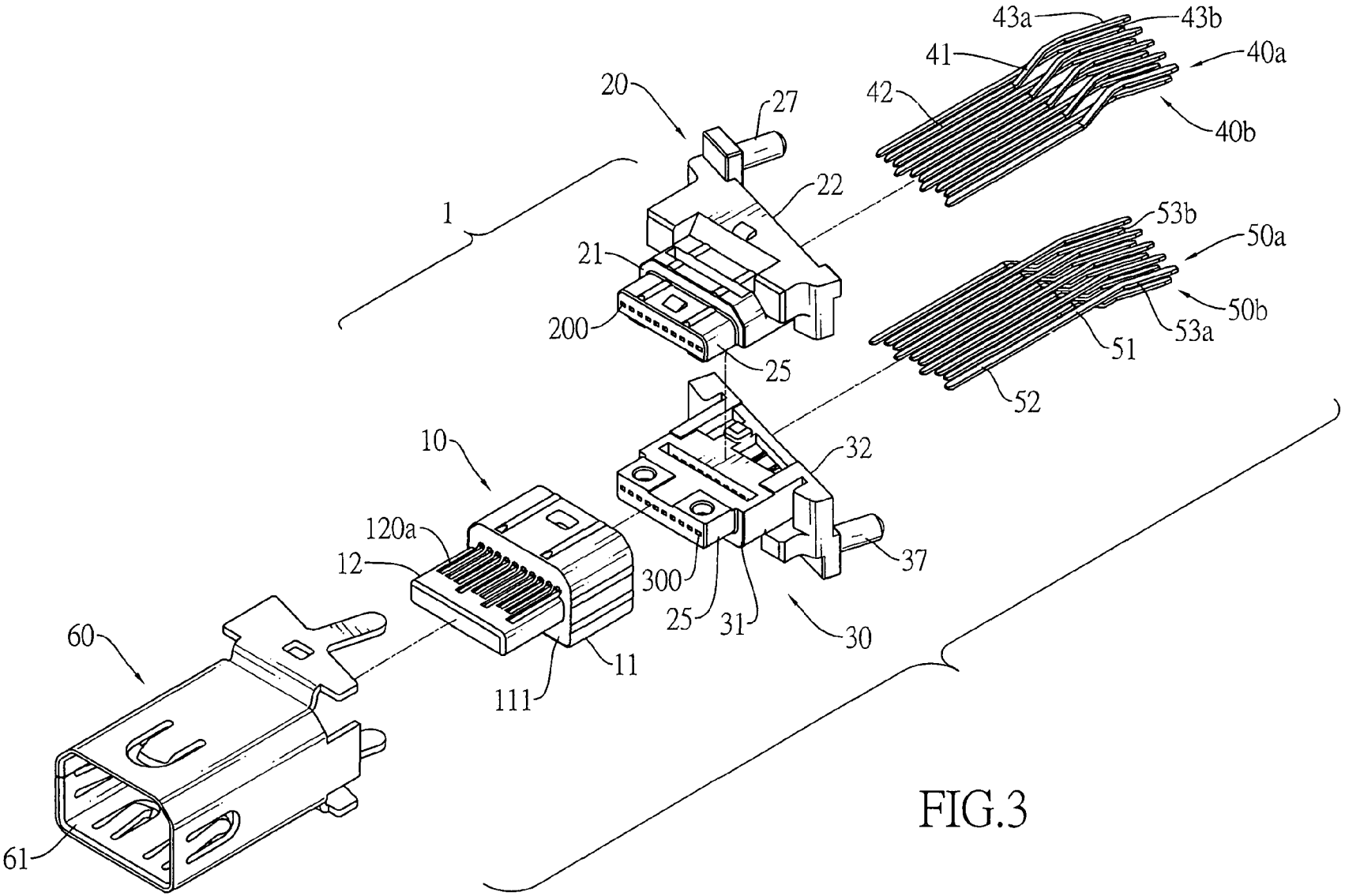
FIG. 3 is an exploded front perspective view of the electrical connector in FIG. 1.
Figure 4:
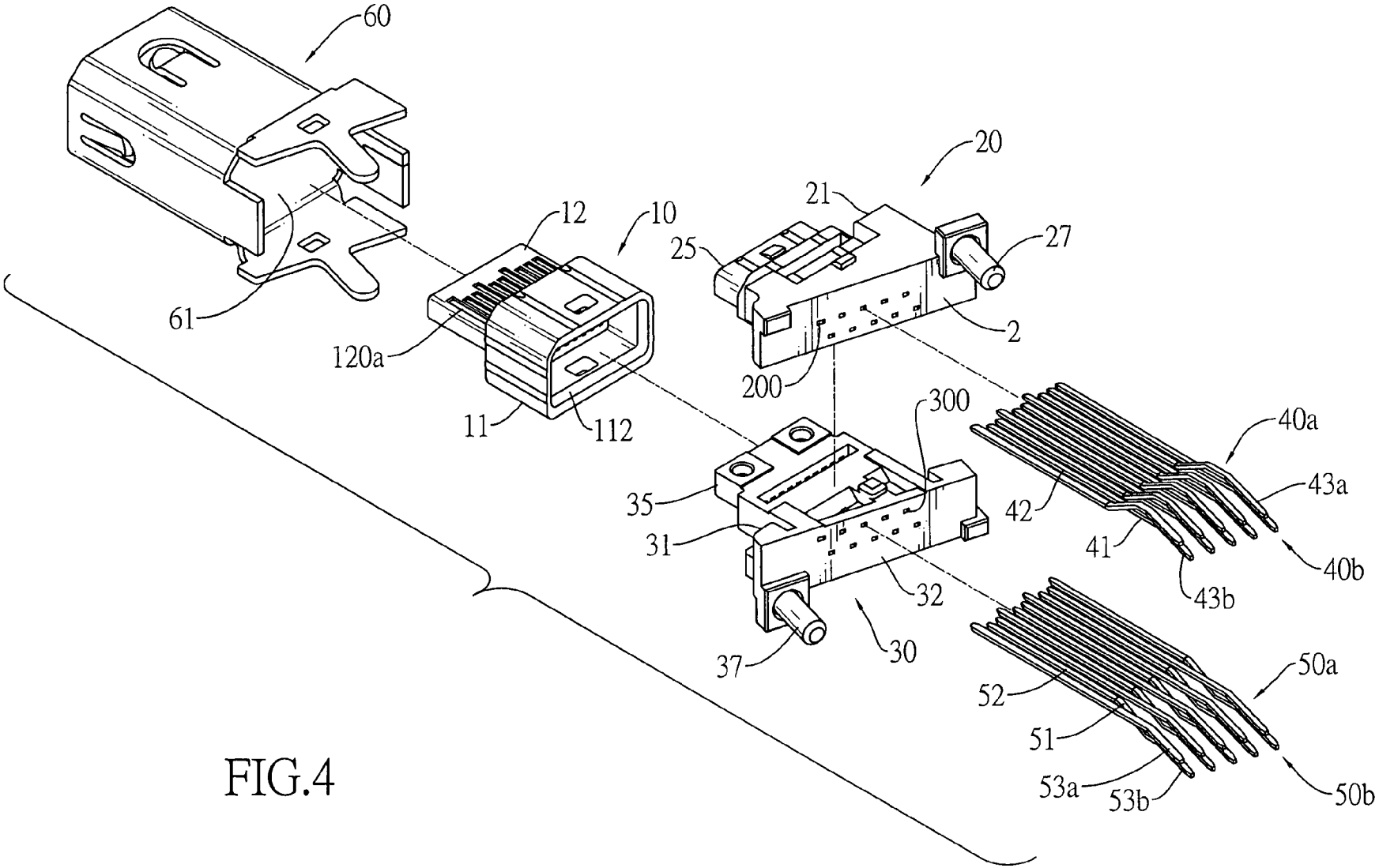
FIG. 4 is an exploded rear perspective view of the electrical connector in FIG. 1.

With reference to FIGS. 1 to 4, an electrical connector in accordance with the present invention may comply with the Display Port protocol set by the Video Electronics Standards Association (VESA) and comprises an insulative housing (1), a plurality of terminals (40*a*, 40*b*, 50*a*, 50*b*) and a metal shell (60).

The insulative housing (1) has a front end and a rear end and may further have a front bracket (10), an upper bracket (20) and a lower bracket (30).

Figure 6:
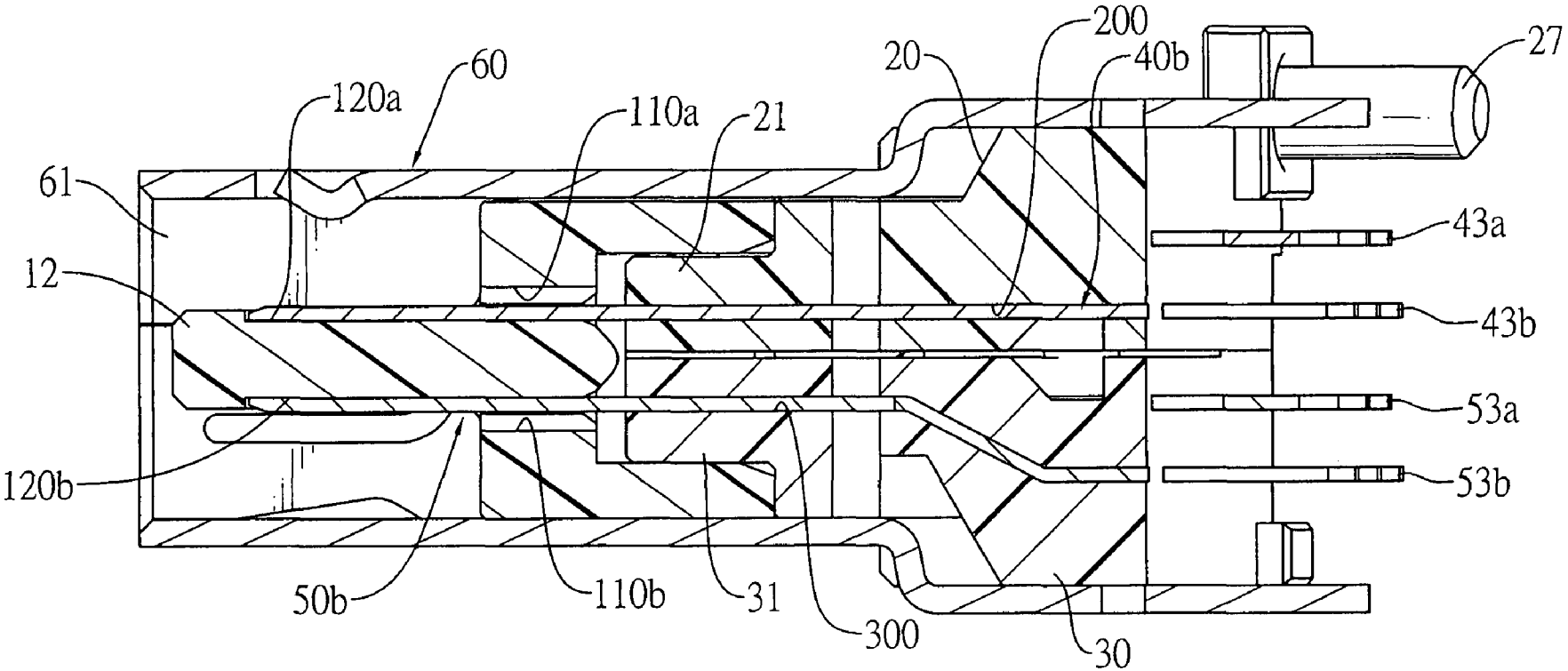
FIG. 6 is a cross sectional side view of the electrical connector in FIG. 1.
Figure 7:
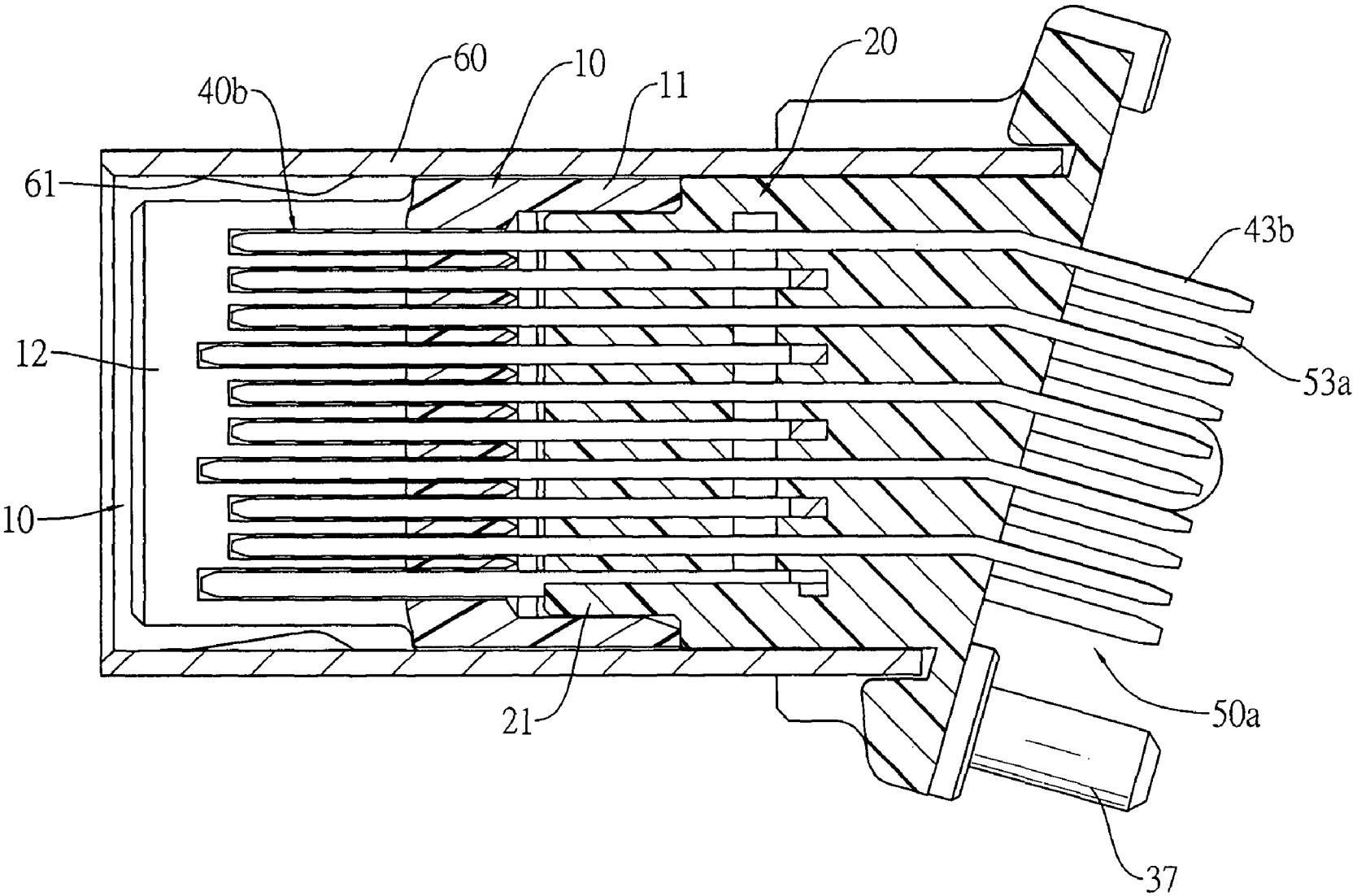
FIG. 7 is a top view in partial section of the electrical connector in FIG. 1.

With further reference to FIG. 6, the front bracket (10) has a connecting member (11) and a tongue (12). The connecting member (11) has a front, a rear, a plurality of upper mounting holes (110*a*), a plurality of lower mounting holes (110*b*) and a fastening hole (112). The upper mounting holes (110*a*) and the lower mounting holes (110*b*) are defined in the connecting member (11). The fastening hole (112) is defined in the rear of the connecting member (11). The tongue (12) is formed on and protrudes forwards from the front of the connecting member (11) and has a top, a bottom, a plurality of upper mounting slots (120*a*) and a plurality of lower mounting slots (120*b*). The upper mounting slots (120*a*) are defined in the top and correspond respectively to the upper mounting holes (110*a*). The lower mounting slots (120*b*) are defined in the bottom and correspond respectively to the lower mounting holes (110*b*).

The upper bracket (20) are mounted on the rear of the connecting member (11) and has a front end, a rear end, a plurality of upper terminal holes (200), at least one mounting post (27) and a fastening protrusion (25). The upper terminal holes (200) are defined in the upper bracket (20). The at least one mounting post (27) is formed on and protrudes from the rear end and may be mounted in a printed circuit board (PCB). The fastening protrusion (25) is formed on and protrudes from the front end and is mounted in the fastening hole (112) of the connecting member (11).

The lower bracket (30) is mounted under the upper bracket (20), is mounted in the rear of the connecting member (11) and has a front end, a rear end, a plurality of lower terminal holes (300), at least one mounting post (37) and a fastening protrusion (35). The lower terminal holes (300) are defined in the lower bracket (30). The at least one mounting post (37) is formed on and protrudes from the rear end of the lower bracket (30) and may be mounted in the PCB. The fastening protrusion (35) is formed on and protrudes from the front end of the lower bracket (30) and is mounted in the fastening hole (112) of the connecting member (11).

The terminals (40*a*, 40*b*, 50*a*, 50*b*) are mounted through the insulative housing (1) and each terminal (40*a*, 40*b*, 50*a*, 50*b*) has a mounting section (41, 51), a contacting section (42, 52) and a soldering section (43, 53).

The mounting section (41, 51) is mounted in the insulative housing (1) and may be mounted in one of the upper and lower terminal holes (200, 300) of the upper and lower brackets (20, 30).

The contacting section (42, 52) is formed on and protrudes forwards from the mounting section (41, 51) adjacent to the front end of the insulative housing (1) and may be mounted in one of the upper and lower mounting slots (120*a*, 120*b*).

Figure 5:
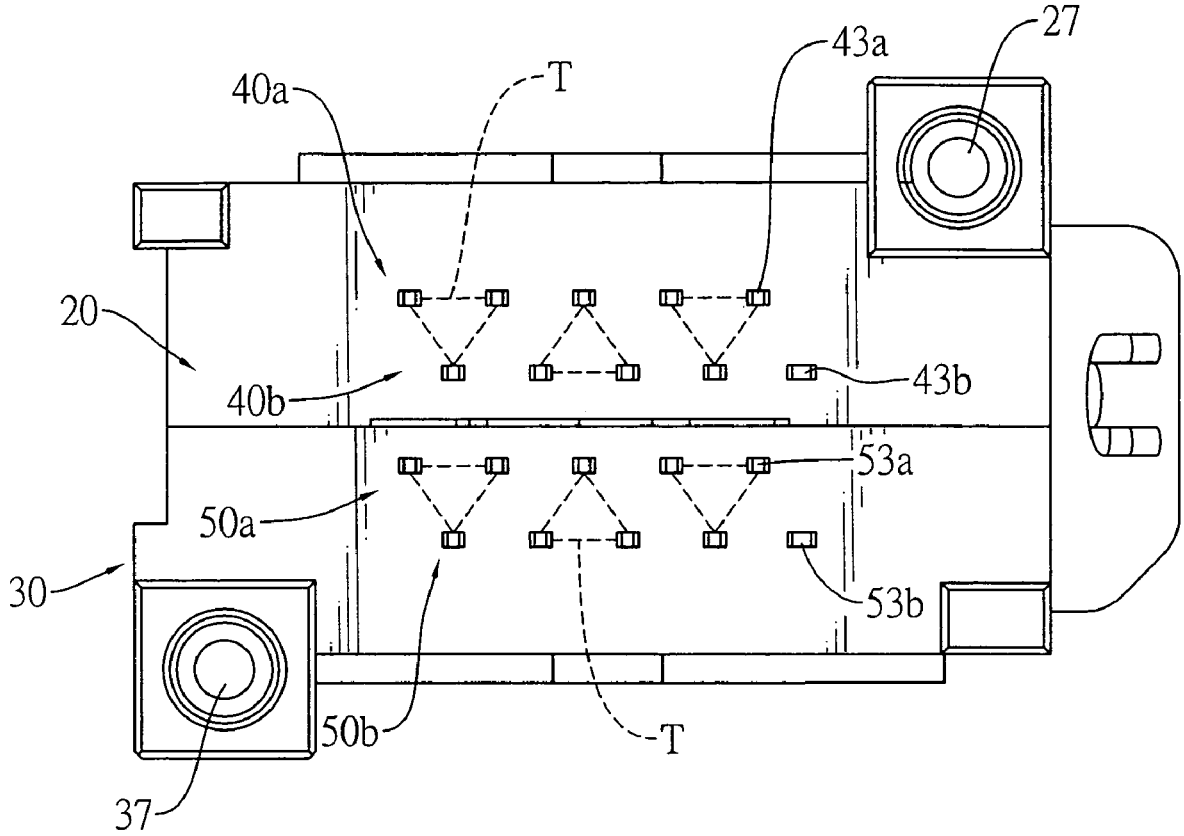
FIG. 5 is a rear view of the electrical connector in FIG. 1.

With further reference to FIG. 5, the soldering section (43*a*, 43*b*, 53*a*, 53*b*) is formed on and protrudes backwards from the mounting section (41, 51) and outside the rear end of the insulative housing (10) and may be outside one of the rear ends of the upper and lower brackets (20, 30). The soldering sections (43*a*, 43*b*, 53*a*, 53*b*) of all the terminals (40, 50) are arranged in triangular patterns (T). In other words, when the upper and lower brackets (20, 30) are observed from the rear ends thereof, the soldering sections (43*a*, 43*b*, 53*a*, 53*b*) are arranged in a layout of a plurality of triangles with each soldering section (43*a*, 43*b*, 53*a*, 53*b*) located in a tip of one triangle (triangular pattern). Distances between one soldering section (43*a*, 43*b*, 53*a*, 53*b*) and adjacent soldering sections (43*a*, 43*b*, 53*a*, 53*b*) are substantially identical. Furthermore, each soldering section (43*a*, 43*b*, 53*a*, 53*b*) and two adjacent soldering sections (43*a*, 43*b*, 53*a*, 53*b*) may be arranged in an equilateral triangle.

In a preferred embodiment, the terminals (40*a*, 40*b*, 50*a*, 50*b*) may be a plurality of first terminals (40*a*), a plurality of second terminals (40*b*), a plurality of third terminals (50*a*) and a plurality of fourth terminals (50*b*).

The contacting sections (42) of the first and second terminals (40*a*, 40*b*) are staggered and arranged in a level row relative to the insulative housing (1). The soldering sections (43*a*, 43*b*) of the first and second terminals (40*a*, 40*b*) are staggered. The soldering sections (43*a*) of the first terminals (40*a*) are arranged in a first level row relative to the insulative housing (1). The soldering sections (43*b*) of the second terminals (40*b*) are arranged in a second level row relative to the insulative housing (1). Furthermore, the first and second terminals (40*a*, 40*b*) are mounted respectively through the upper terminal holes (200), are mounted respectively through the upper mounting holes (110*a*) and are mounted respectively in the upper mounting slots (120*a*).

The third and fourth terminals (50*a*, 50*b*) are located under the first and second terminals (40*a*, 40*b*). The contacting sections (52) of the third and fourth terminals (50*a*, 50*b*) are staggered and arranged in a level row relative to the insulative housing (1). The soldering sections (53*a*, 53*b*) of the third and fourth terminals (50*a*, 50*b*) are staggered. The soldering sections (53*a*) of the third terminals (50*a*) are arranged in a third level row relative to the insulative housing (1). The soldering sections (53*b*) of the fourth terminals (50*b*) are arranged in a fourth level row relative to the insulative housing (1). Furthermore, the third and fourth terminals (50*a*, 50*b*) are mounted respectively through the lower terminal holes (300), are mounted respectively through the lower mounting holes (110*b*) and are mounted respectively in the lower mounting slots (120*b*).

In a preferred embodiment, the first and second terminals (40*a*, 40*b*) have four signal transmitting terminals and two grounding terminals. The third and fourth terminals (50*a*, 50*b*) have four signal terminals and two grounding terminals.

The metal shell (60) covers the insulative housing (1) and the terminals (40*a*, 40*b*, 50*a*, 50*b*) and has an internal space defined in the metal shell (60) for receiving a corresponding plug connector.

Figure 8:
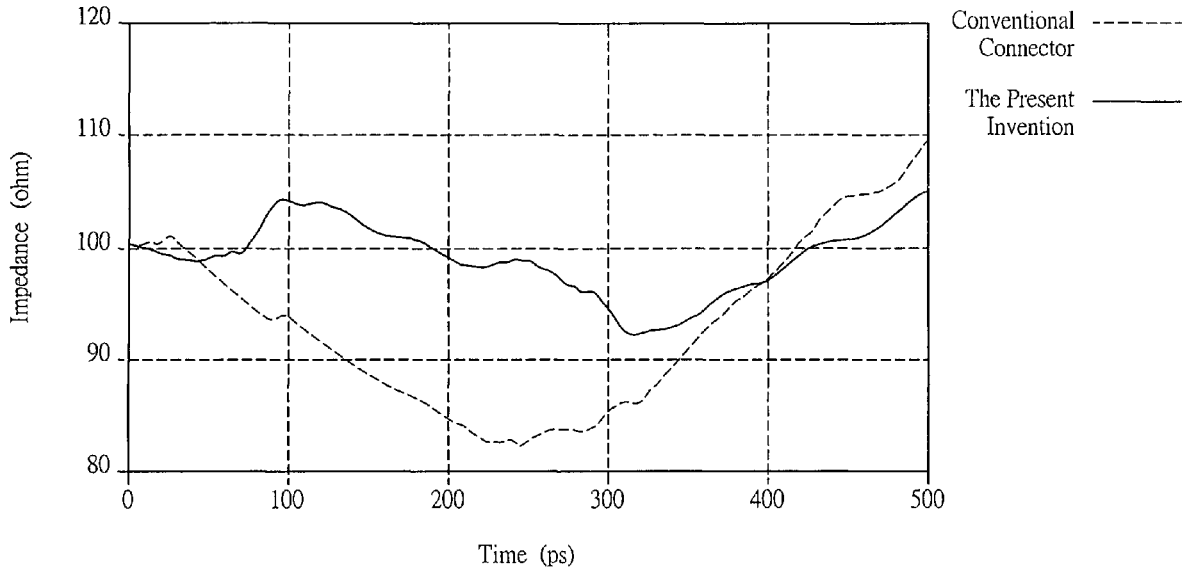
FIG. 8 is an impedance-time curve diagram showing curves of the electrical connector in FIG. 1 and a conventional connector during the signal transmission.

With further reference to FIG. 8, an impedance-time curve diagram shows two curves respectively indicating the electrical connector of the present invention and a conventional connector without triangular layouts of terminals during the signal transmission. The unit of the impedance is "ohm" and that of the time is "$10^{-2}$ second (Pico-second, PS)". As indicated by the curves, when signal transmission is implemented, the impedance of the conventional connector vibrates up and down more violently than that of the electrical connector of the present invention. Therefore, the electrical connector of the present invention with the triangular terminal layout improves the stability of the impedance and advantages the high frequency signal transmission.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An electrical connector comprising:

an insulative housing having a front end and a rear end;

a plurality of terminals mounted through the insulative housing and each terminal having a mounting section mounted in the insulative housing;

a contacting section formed on and protruding forwards from the mounting section adjacent to the front end of the insulative housing; and a soldering section formed on and protruding backwards from the mounting section outside the rear end of the insulative housing, and the soldering sections of all the terminals arranged in triangular patterns, each soldering section located at a tip of one triangular pattern and distances between one soldering section and adjacent soldering sections being substantially identical; and a metal shell covering the insulative housing and the terminals; and wherein the terminals have a plurality of first terminals and a plurality of second terminals;

the contacting sections of the first and second terminals are staggered and arranged in a level row relative to the insulative housing;

the soldering sections of the first and second terminals are staggered;

the soldering sections of the first terminals are arranged in a first level row relative to the insulative housing; and the soldering sections of the second terminals are arranged in a second level row relative to the insulative housing.

2. The electrical connector as claimed in claim 1, wherein each soldering section and two adjacent soldering sections are arranged in an equilateral triangle.

3. The electrical connector as claimed in claim 2, wherein the terminals further has a plurality of third terminals and a plurality of fourth terminals located under the first and second terminals;

the contacting sections of the third and fourth terminals are staggered and arranged in a level row relative to the insulative housing;

the soldering sections of the third and fourth terminals are staggered;

the soldering sections of the third terminals are arranged in a third level row relative to the insulative housing; and the soldering sections of the fourth terminals are arranged in a fourth level row relative to the insulative housing.

4. The electrical connector as claimed in claim 3, wherein the insulative housing further has a front bracket having a connecting member having a front, a rear, a plurality of upper mounting holes and a plurality of lower mounting holes defined in the connecting member; and a tongue formed on and protruding forwards from the front of the connecting member and having a top and a bottom and further having a plurality of upper mounting slots defined in the top and a plurality of lower mounting slots defined in the bottom;

an upper bracket mounted on the rear of the connecting member and having a front end, a rear end and a plurality of upper terminal holes defined in the upper bracket; and a lower bracket mounted under the upper bracket, mounted in the rear of the connecting member and having a front end, a rear end and a plurality of lower terminal holes defined in the lower bracket;

the first and second terminals are mounted respectively through the upper terminal holes, are mounted respectively through the upper mounting holes and are mounted respectively in the upper mounting slots; and the third and fourth terminals are mounted respectively through the lower terminal holes, are mounted respectively through the lower mounting holes and are mounted respectively in the lower mounting slots.

5. The electrical connector as claimed in claim 4, wherein the front bracket further has a fastening hole defined in the rear of the connector member;

the upper bracket further has a fastening protrusion formed on and protruding from the front end and mounted in the fastening hole of the connecting member; and the lower bracket further has a fastening protrusion formed on and protruding from the front end of the lower bracket and mounted in the fastening hole of the connecting member.

6. The electrical connector as claimed in claim 5, wherein the upper bracket further has at least one mounting post formed on and protruding from the rear end of the upper bracket.

7. The electrical connector as claimed in claim 6, wherein the lower bracket further has at least one mounting post formed on and protruding from the rear end of the lower bracket.

* * * * *